US010643599B2

(12) United States Patent
Sterling

(10) Patent No.: US 10,643,599 B2
(45) Date of Patent: May 5, 2020

(54) ACOUSTIC LENS FOR A TRANSDUCER

(71) Applicant: Harman International Industries, Incorporated, Stamford, CT (US)

(72) Inventor: Brian Sterling, Farmington Hills, MI (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 351 days.

(21) Appl. No.: 15/636,971

(22) Filed: Jun. 29, 2017

(65) Prior Publication Data

US 2019/0005941 A1 Jan. 3, 2019

(51) Int. Cl.

| | |
|---|---|
| ***G10K 11/30*** | (2006.01) |
| ***H04R 1/34*** | (2006.01) |
| ***H04R 1/20*** | (2006.01) |

(52) U.S. Cl.

CPC ..... *G10K 11/30* (2013.01); *H04R 1/20* (2013.01); *H04R 1/345* (2013.01)

(58) Field of Classification Search

CPC ..... G10K 11/30; H04R 1/323; H04R 1/345
USPC ..... 181/176, 191; 381/337, 339, 343
See application file for complete search history.

(56) References Cited

U.S. PATENT DOCUMENTS 3,326,321 A * 6/1967 Valuch ..... H04R 1/345 181/144
3,371,742 A * 3/1968 Norton ..... H04R 1/345 181/153
4,348,549 A * 9/1982 Berlant ..... H04R 1/26 181/152
4,620,317 A * 10/1986 Anderson ..... H04R 1/345 181/155
5,115,882 A * 5/1992 Woody ..... H04R 1/345 181/144
5,125,732 A * 6/1992 Jacobson ..... H04R 1/30 352/1
5,359,158 A * 10/1994 Queen ..... H04R 1/025 181/150
5,673,329 A * 9/1997 Wiener ..... H04R 1/34 181/144
5,721,401 A * 2/1998 Sim ..... H04R 1/345 181/148
5,832,099 A * 11/1998 Wiener ..... H04R 1/2888 381/386

(Continued)

FOREIGN PATENT DOCUMENTS

DK 177561 B1 10/2013

OTHER PUBLICATIONS

Timothy Gladwin, et al., US Patent Application entitled Acoustic Lens System for Loudspeakers, filed Dec. 28, 2016 as U.S. Appl. No. 15/392,645. (30 Pages).

(Continued)

*Primary Examiner* — Jeremy A Luks
(74) *Attorney, Agent, or Firm* — Brooks Kushman P.C.

(57) ABSTRACT

An acoustic lens for a transducer. In at least one embodiment, the acoustic lens includes a body aligned on an axis. The body includes a top surface, a sidewall that extends from the top surface, and a bottom surface that is generally opposite the top surface. The sidewall includes an opening for a soundwave from the transducer to travel through in an off-axis direction.

18 Claims, 5 Drawing Sheets

(56) References Cited

U.S. PATENT DOCUMENTS

| | | | | |
|---|---|---|---|---|
| 5,995,634 | A * | 11/1999 | Zwolski | H04R 1/028 181/155 |
| 6,603,862 | B1 * | 8/2003 | Betts | H04R 1/345 181/155 |
| 7,702,123 | B2 * | 4/2010 | Soerensen | H04N 5/642 181/176 |
| 8,135,162 | B2 | 3/2012 | Holt et al. | |
| 8,181,736 | B2 | 5/2012 | Sterling et al. | |
| 8,418,802 | B2 | 4/2013 | Sterling et al. | |
| 8,477,967 | B2 * | 7/2013 | Harwood | H04R 5/02 181/153 |
| 8,672,088 | B2 | 3/2014 | Sterling et al. | |
| 9,883,282 | B2 * | 1/2018 | Goksel | H04R 1/345 |
| 2004/0020711 | A1 * | 2/2004 | China | H04R 1/2865 181/176 |
| 2015/0201279 | A1 | 7/2015 | Sprinkle | |
| 2016/0227315 | A1 * | 8/2016 | Kim | H04R 1/2819 |

OTHER PUBLICATIONS

Harman Kardon Automotive Subaru Legacy; Last accessed Jun. 23, 2017; http://www.harmankardon.com/subaru-legacy.html. (2 pages).
Harman Kardon Automotive Chrysler 300; Last accessed Jun. 23, 2017; http://www.harmankardon.com/chrysler-300c.html. (2 pages).
Mark Levinson, The Lexus RC Audio System Overview; Last accessed Jun. 23, 2017; http://www.marklevinson.com/lexus-rc.html. (5 pages).

* cited by examiner

ACOUSTIC LENS FOR A TRANSDUCER

TECHNICAL FIELD

Embodiments disclosed herein generally relate to an acoustic lens for a transducer.

BACKGROUND

In a vehicle, a tweeter typically mounts to a surface of a dashboard. The tweeter aligns on an axis that is perpendicular to the surface of the dashboard. A soundwave generated by the tweeter travels along the axis. However, in relation to the axis, a seat in a vehicle is at an off-axis position. Therefore, a soundwave traveling along the axis is not directed toward the seat. In order to reach the seat, the soundwave may need to reflect off of one or more surfaces. This may adversely affect a listening experience at the seat. For example, the adverse listening experience may include noticeable resonances, subdued sounding high frequencies, or an instable/shifting center sound image.

SUMMARY

One embodiment provides an acoustic lens for a transducer. The acoustic lens is configured to be positioned in front of an output side of the transducer. The acoustic lens includes a top surface aligned on an axis and having a perimeter distal to the axis. The acoustic lens further includes a sidewall that extends from the perimeter of the top surface. The sidewall includes a leg. The leg and the top surface define an opening for a soundwave from the transducer to travel through. In relation to the axis, the soundwave would travel through the opening in an off-axis direction. The acoustic lens further includes a bottom surface that is generally opposite the top surface. The bottom surface is configured to direct the soundwave from the transducer to travel through the opening.

Another embodiment provides an acoustic assembly. The acoustic assembly includes a transducer aligned on an axis. The transducer is configured to generate a soundwave to travel in a direction along the axis. The acoustic assembly further includes an acoustic lens aligned on the axis and positioned in front of an output side of the transducer. The acoustic lens is configured to direct the soundwave from the transducer from traveling in the direction along the axis to traveling in an off-axis direction. The acoustic lens includes a top surface. Additionally, the acoustic lens includes a leg. The leg extends from the top surface. The leg and the top surface define an opening for the soundwave from the transducer to travel through in the off-axis direction. The acoustic lens further includes a bottom surface that is generally opposite the top surface. The bottom surface is configured to direct the soundwave from the transducer to travel through the opening.

Another embodiment provides an acoustic assembly. The acoustic assembly includes a transducer aligned on an axis. The transducer is configured to generate a soundwave to travel in a direction along the axis. Additionally, the acoustic assembly includes a horn that is positioned in front of an output side of the transducer. The acoustic assembly further includes an acoustic lens that is at least partially positioned in front of an output side of the horn. The acoustic lens is configured to direct the soundwave from traveling in the direction along the axis to traveling in an off-axis direction. The acoustic assembly includes a phase plug positioned within the horn.

As such, and among other benefits, embodiments herein may achieve clean reproduction of high frequencies, resonances that are unobtrusive, and a center sound image that is firm and stable.

DETAILED DESCRIPTION

Figure 1:
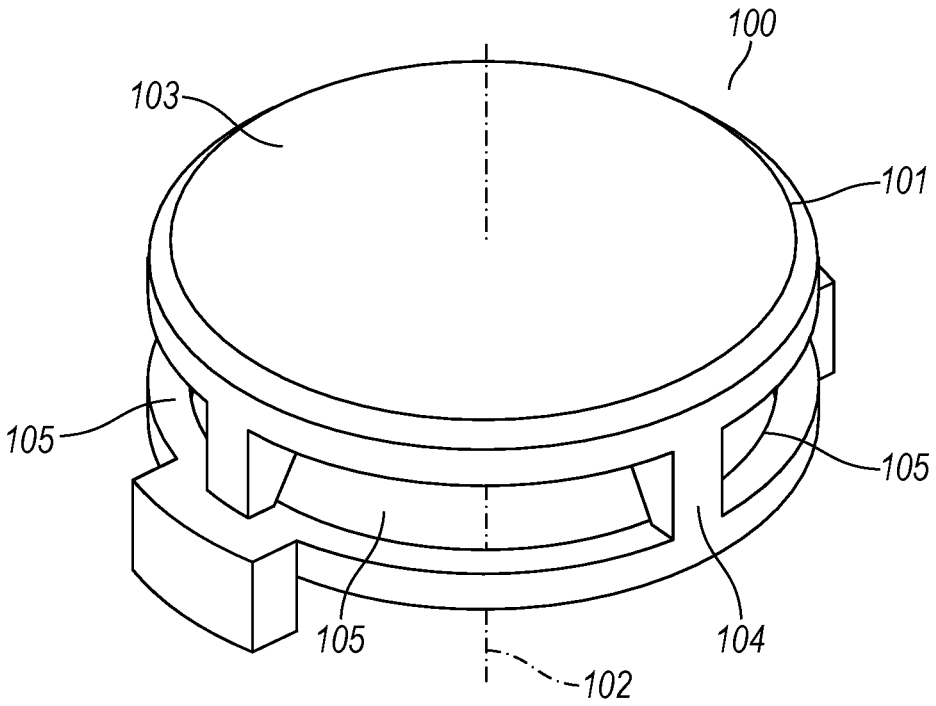
FIG. 1 illustrates a perspective view of an acoustic lens according to one or more embodiments.
Figure 2:
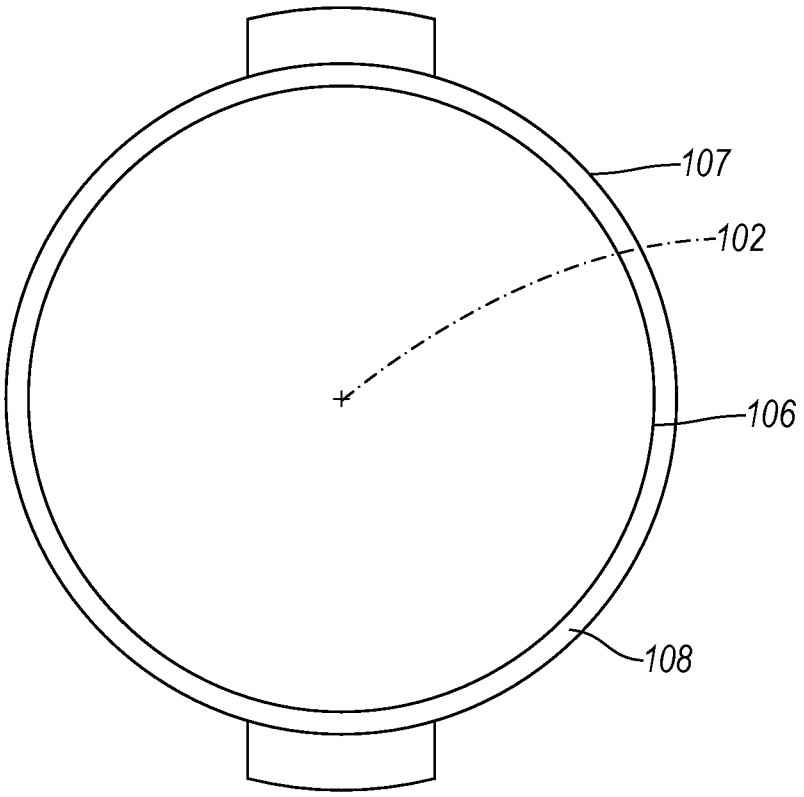
FIG. 2 illustrates a top view of the acoustic lens of FIG. 1.
Figure 3:
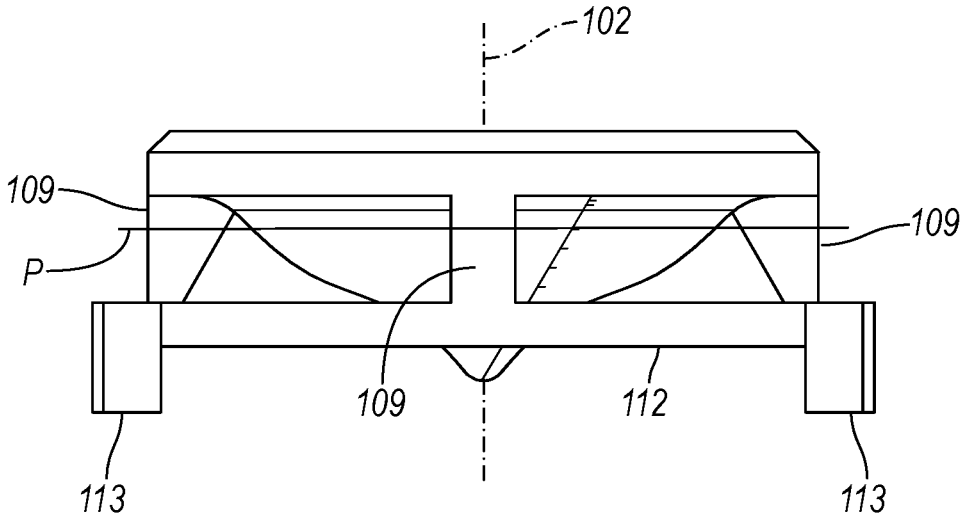
FIGS. 3-4 illustrate side views of the acoustic lens of FIG. 1.
Figure 4:
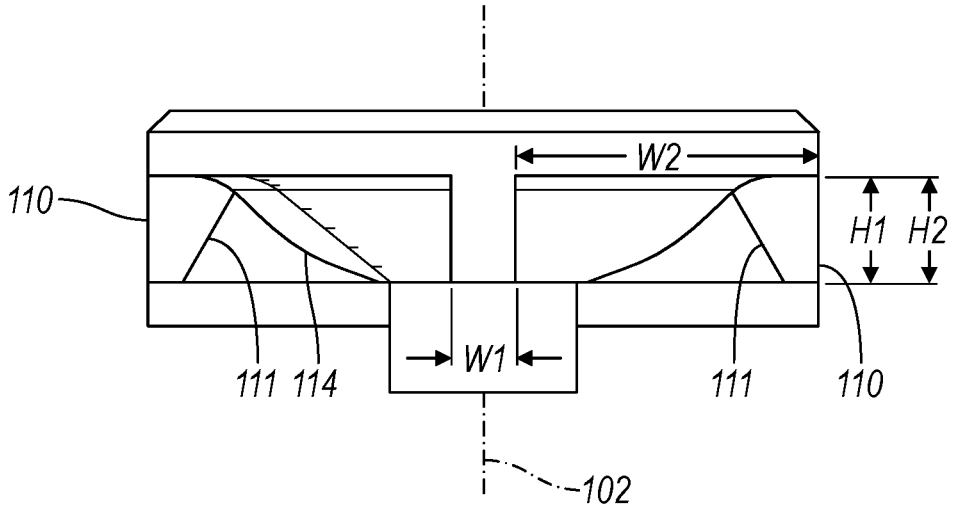
Figure 5:
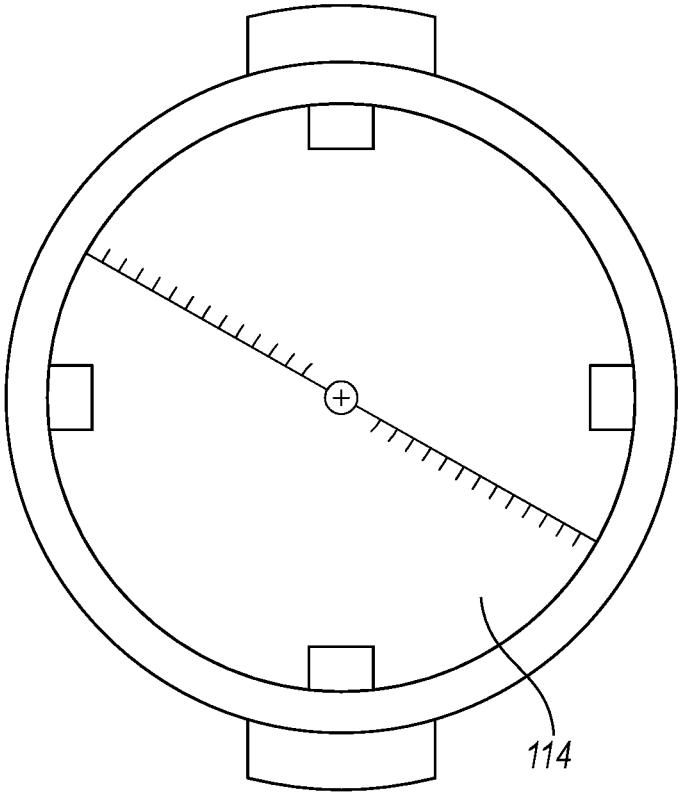
FIG. 5 illustrates a bottom view of the acoustic lens of FIG. 1.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

One or more embodiments may provide an acoustic assembly. The acoustic assembly may include a transducer aligned on an axis. The transducer may generate a soundwave to travel in a direction along the axis. In addition to the transducer, the acoustic assembly may include an acoustic lens positioned in front of the transducer. The acoustic lens may be attached to the transducer. The acoustic lens may direct a soundwave from the transducer from traveling in the direction along the axis to traveling in at least one off-axis direction.

The at least one off-axis direction may relate to a seat for a listener in a listening environment. For example, compared to the axis, the at least one off-axis direction may be directed toward a headrest of the seat in the listening environment. When the seat is occupied by a listener, the listener's head may rest against the headrest. In such an example, the user's ears may be near the headrest. As such, a soundwave traveling along the at least one off-axis direction may be directed toward the listener's ears. Compared to a soundwave that merely travels along the axis, the soundwave directed toward the listener's ears may result in an improved listening experience for the listener. The improved listening experience may result because directing the soundwave through the acoustic lens may result in an acoustical sweetspot at the seat.

FIGS. 1 through 5 illustrate an acoustic lens 100 for a transducer, which is in accordance with one or more embodiments. The acoustic lens 100 includes a body 101. The body 101 is aligned on an axis 102. Moreover, the body 101 includes a top surface 103 and a sidewall 104. The sidewall 104 extends from the top surface 103. In relation to the axis 102, the sidewall 104 includes at least one opening 105 for a soundwave from a transducer to travel through in an off-axis direction. The at least one opening 105 may, therefore, influence a listening experience at a seat in a listening environment.

As an example, the at least one opening 105 may include a plurality of openings. Each opening in the plurality of openings may be radially and equally spaced from one another in relation to the axis 102. Through each opening in the plurality of openings, a soundwave from a transducer may travel in an off-axis direction. For example, when the plurality of openings includes a first opening and a second opening, a soundwave from a transducer may travel through the first opening in a first off-axis direction and through the second opening in a second off-axis direction. Neither the first off-axis direction nor the second off-axis direction run parallel to the axis 102.

A plane P may intersect the at least one opening 105. The plane P may be oriented 90° to the axis 102. About the axis 102 on the plane P, the at least one opening 105 may provide nearly 360° line-of-sight. The nearly 360° line-of-sight may be divided by the number of openings. Doing so may approximate the portion of the line-of-sight that each opening contributes to the line-of-sight. One benefit of the nearly 360° line-of-sight is increased flexibility in seat positioning in a listening environment. For example, the nearly 360° line-of-sight on plane P results in an off-axis acoustic radiation pattern of 360° about the axis 102. Another benefit is increased tuning flexibility for the listening environment. At times it may be desirable to have a direct off-axis soundwave that first reaches a seat location and an indirect off-axis soundwave, such as a reflection off of a surface located elsewhere in the listening environment, that subsequently reaches the seat location. For example, in a vehicle, a direct off-axis soundwave could first reach a driver's seat, and an indirect off-axis soundwave could reflect off of a windshield and subsequently hit the driver's seat after the direct off-axis soundwave reaches the driver's seat. This may be possible because of the nearly 360° line-of-sight of the acoustic lens 100.

As an alternative, the at least one opening 105 may provide a line-of-sight that is less than nearly 360°. For example, the line-of-sight of the at least one opening 105 may be 180°. This may result in an off-axis acoustic radiation pattern of 180° about the axis 102. The remaining portion of the sidewall 104 could therefore be solid. This may result as part of the forming operation of the sidewall 104. Alternatively, this may result by inserting a plug into at least a portion of the at least one opening 105. Adjusting the line-of-sight to less than nearly 360° may be desirable where a surface is not ideal or not present to reflect off of. For example, in a convertible vehicle where the convertible top is made of a canvas material and the convertible top is up, the convertible top may not be ideal for reflecting soundwaves off of. Moreover, when down, the lack of the convertible top may result in no surface to reflect soundwaves off of.

The top surface 103 may include a planar region 106 that laterally extends from the axis 102. The planar region may be oriented 90° to the axis 102. Moreover, the top surface 103 may include a perimeter 107. The perimeter 107 may be distal to the axis 102. The planar region 106 may directly terminate at the perimeter 107. Alternatively, between the planar region 106 and the perimeter 107, the top surface 103 may include a transitional region 108. The transitional region 108 may be a bevel. The planar region 106 may have a circular or a polygonal profile. The perimeter 107 may also have a circular or a polygonal profile. The planar region 106 and the perimeter 107 may be centered on the axis 102 such that the planar region 106 and perimeter 107 are coaxially aligned on the axis 102.

The sidewall 104 may extend from the perimeter 107 of the top surface 103. The sidewall 104 and the top surface 103 may be centered on the axis 102 such that the sidewall 104 and the top surface 103 are coaxially aligned on the axis 102. The sidewall 104 may include at least one leg 109. The at least one leg 109 may extend from the perimeter 107. The at least one leg 109 and the top surface 103 may define the at least one opening 105.

The at least one leg 109 may have an outer surface 110 and an inner surface 111. The outer surface 110 may extend in a direction that is parallel to the axis 102. The outer surface 110 may be a radial segment in relation to the axis 102. The outer surface 110 may include a width dimension W1 in relation to the axis 102. Additionally, the outer surface 110 may include a height dimension H1 in relation to the axis 102. The height direction H1 extends in the direction that is parallel to the axis 102. The width dimension W1 may be perpendicular to the height direction H1. The width dimension W1 of the outer surface may be less than a width dimension W2 of the at least one opening 105. The height dimension H1 may be equal to a height dimension H2 of the at least one opening 105. The height dimension H2 may be a maximum height for the at least one opening 105. Generally opposite to the outer surface 110, the inner surface 111 may extend in a direction that intersects the axis 102. The inner surface 111 may be a conical segment in relation to the axis 102.

The sidewall 104 may also include a rim 112 that extends from the at least one leg 109. The rim 112 may be centered on the axis 102. The rim 112 and the top surface 103 may be coaxially aligned on the axis 102. The rim 112 may include a circular or a polygonal profile. The rim 112, the at least one leg 109, and the top surface 103 may define the at least one opening 105.

As an example, the at least one leg 109 may include a plurality of legs. The plurality of legs may be radially and equally spaced from one another. The plurality of legs may extend from the perimeter 107 of the top surface 103. The rim 112 may extend from the plurality of legs. The rim 112 may provide structural rigidity to the plurality of legs. The number of legs in the plurality may determine the number of openings in the sidewall 104.

The acoustic lens 100 may include at least one foot 113 that extends from the rim 112 or the at least one leg 109. The at least one foot 113 may attach to a frame of a transducer. The at least one foot 113 may be adhered, welded, molded, fastened via fasteners, held in place by a frictional interference engagement, or otherwise removably or permanently affixed to a frame of a transducer. Alternatively, the acoustic lens 100 may attach to a horn or a phase plug of a transducer. This may be by adhering, welding, molding, fastening, holding via frictional interference engagement, or other removable or permanent affixing.

The acoustic lens 100 may include a bottom surface 114 generally opposite the top surface 103 on the body 101. The bottom surface 114 may be aligned on the axis 102. The bottom surface 114 may include a taper that extends inward from the perimeter 107 of the top surface 103 toward the axis 102 and decreases in size at a constant rate. Alternatively, the bottom surface 114 may include a non-uniform profile in relation to the axis 102. The non-uniform profile may be a curve. The equation of the curve for the non-uniform profile may be based on a non-linear equation. The non-uniform profile may include transverse dimensioning in relation to the axis 102 that varies at a non-constant rate.

The bottom surface 114 may direct a soundwave from a transducer to travel through the at least one opening 105. The bottom surface 114 may serve to smoothly transition a soundwave from traveling in a direction along the axis 102 to traveling in an off-axis direction and out of the at least one opening 105. The smooth transition of the bottom surface 114 may prevent the soundwave from reflecting back on itself. For example, compared to the smooth transition, a flat surface oriented 90° to the axis 102 could cause a soundwave traveling along the axis 102 to reflect back on itself. In such a case, the soundwave may not exit through a desired off-axis opening, but instead wastefully reflect. To stave off such wasteful reflections, the bottom surface 114 may smoothly transition a soundwave from traveling in an on-axis direction to traveling in an off-axis direction. The smooth transition may be accomplished by virtue of the bottom surface's profile. The bottom surface 114 and the top surface 103 may be solid or form a hollow cavity. The bottom surface 114 may include a phase plug for a transducer. As an alternative, the bottom surface 114 may be designed to work with a separate phase plug for a transducer.

Figure 6:
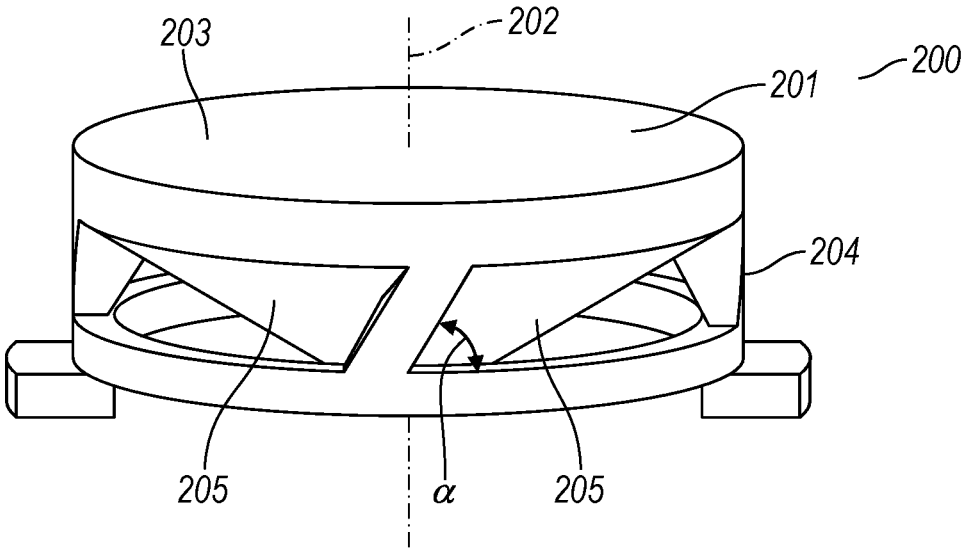
FIG. 6 illustrates a perspective view of an acoustic lens according to one or more embodiments.

FIG. 6 illustrates an acoustic lens 200 for a transducer, which is in accordance with one or more embodiments. The acoustic lens includes a body 201. The body 201 is aligned on an axis 202. Moreover, the body 201 includes a top surface 203 and a sidewall 204. The sidewall 204 extends from the top surface 203. In relation to the axis 202, the sidewall 204 includes at least one opening 205 for a soundwave from a transducer to travel through in an off-axis direction.

The at least one opening 205 may include a plurality of openings. Each opening in the plurality of openings may be radially and equally spaced from one another in relation to the axis 202. Each opening in the plurality of openings may influence a directivity of a soundwave from a transducer. When viewed from a two-dimensional point-of-view, each opening may be shaped as a rectangle, a circle, an ellipse, a square, a parallelogram, a trapezoid, or another two-dimensional shape. Each opening may include an angle $\alpha$ that is less than 90°, 90°, or greater than 90°. The shape of each opening, such as the angle $\alpha$, may be selected to achieve a desired listening experience at a seat in a listening environment, such as by influencing a directivity of a soundwave.

Figure 7:
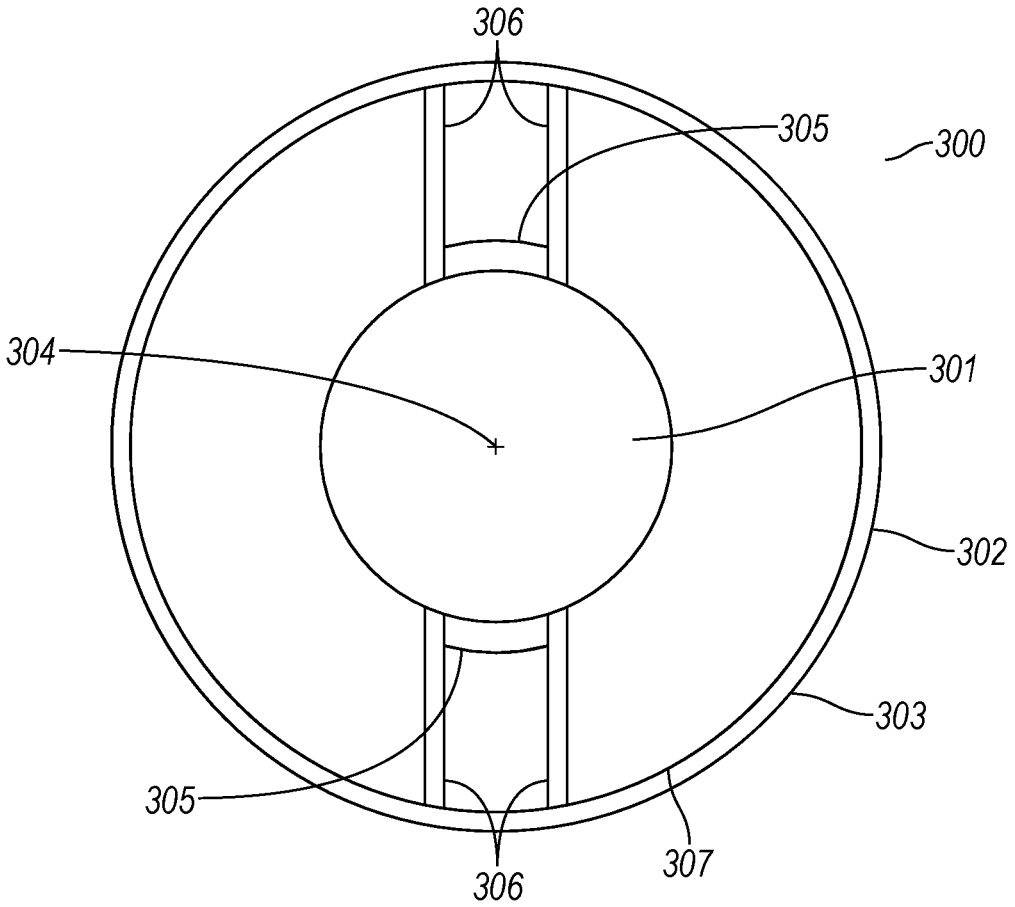
FIG. 7 illustrates a top view of an acoustic assembly according to one or more embodiments.

FIG. 7 illustrates an acoustic assembly 300, which is in accordance with one or more embodiments. The acoustic assembly 300 includes an acoustic lens 301 that is attached to a transducer 302. The transducer 302 includes a frame 303. The acoustic lens 301 may be attached to the frame 303. The acoustic lens 301 and the transducer 302 may be aligned on an axis 304. The acoustic lens 301 may direct a soundwave from the transducer 302 from traveling in the direction along the axis 304 to traveling in at least one off-axis direction. The acoustic lens 301 may include at least one foot 305. The at least one foot 305 may engage the frame 303. Moreover, the at least one foot 305 may abut against at least one inner segment 306 of the frame 303. The at least one inner segment 306 may extend inward from a periphery 307 of the frame 303. Additionally or alternatively, the at least one foot 305 may abut against the periphery 307. The at least one foot 305 may be adhered, welded, molded, fastened via fasteners, held in place by a frictional interference engagement, or otherwise removably or permanently affixed to the frame 303 of the transducer 302. The transducer 302 may be a compression driver, a loudspeaker, another-type of electroacoustic transducer, or a plurality thereof.

Figure 8:
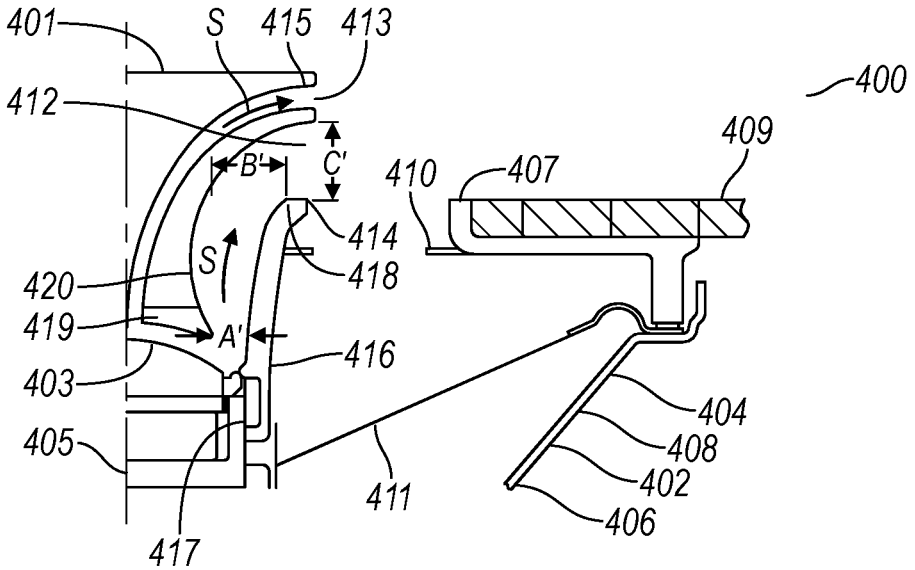
FIG. 8 illustrates a partial section view of an acoustic assembly according one or more embodiments.

FIG. 8 illustrates a partial section view of an acoustic assembly 400, which is in accordance with one or more embodiments. The acoustic assembly 400 includes an acoustic lens 401 and a transducer 402. The transducer 402 includes a first electroacoustic transducer 403 and a second electroacoustic transducer 404. The first electroacoustic transducer 403 may operate over a first range of frequencies, and the second electroacoustic transducer 404 may operate over a second range of frequencies.

For example, the first electroacoustic transducer 403 may be a tweeter, and the second electroacoustic transducer 404 may be a mid-range loudspeaker. The tweeter may operate over the first range of frequencies. The first range of frequencies may be from 2,000 Hz to 20,000 Hz. The mid-range loudspeaker may operate over the second range of frequencies. The second range of frequencies may be from 200 Hz to 2,000 Hz.

The first electroacoustic transducer 403 and the second electroacoustic transducer 404 may be aligned on an axis 405. Therefore, the first electroacoustic transducer 403 and the second electroacoustic transducer 404 may be coaxially aligned on the axis 405. The first electroacoustic transducer 403 may attach to the second electroacoustic transducer 404. For example, the first electroacoustic transducer 403 may be adhered, welded, molded, fastened via fasteners, held in place by a frictional interference engagement, or otherwise removably or permanently affixed to the second electroacoustic transducer 404. From the axis 405, the first electroacoustic transducer 403 may have a first lateral dimension, and the second electroacoustic transducer 404 may have a second lateral dimension. The first lateral dimension may be shorter than the second lateral dimension. The first lateral dimension and the second lateral dimension are perpendicular to the axis 405.

The transducer 402 includes a frame 406. The acoustic lens 401 may attach to the frame 406. Additionally or alternatively, the acoustic lens 401 may attach to the first electroacoustic transducer 403. The acoustic lens 401 may be adhered, welded, molded, fastened via fasteners, held in place by a frictional interference engagement, or otherwise removably or permanently affixed to the frame 406 and/or the first electroacoustic transducer 403. The acoustic lens 401 may be aligned on the axis 405. Therefore, the acoustic lens 401 and the transducer 402 may be coaxially aligned on the axis 405.

The frame 406 may include an upper bracket 407 attached to a lower bracket 408. The upper bracket may be adhered, welded, molded, fastened via fasteners, held in place by a frictional interference engagement, or otherwise removably or permanently affixed to the lower bracket. The upper bracket 407 may attach to a surface 409. The upper bracket 407 may be adhered, welded, molded, fastened via fasteners, held in place by a frictional interference engagement, or otherwise removably or permanently affixed to the surface 409. The surface 409 may be a dashboard or a roof of a vehicle. The upper bracket 407 may include at least one inner segment 410. The at least one inner segment 410 may engage and abut against the acoustic lens 401. A diaphragm 411 of the second electroacoustic transducer 404 may attach to the upper bracket 407 and/or the lower bracket 408.

The acoustic lens 401 may be positioned in front of an output side of the first electroacoustic transducer 403. The acoustic lens 401 may include a primary path 412 for a soundwave S from the first electroacoustic transducer 403 to travel out of in an off-axis direction. The acoustic lens 401 may include a secondary path 413 for the soundwave S from the first electroacoustic transducer 403 to travel out of in an off-axis direction. The primary path 412 may include at least one opening 414. The secondary path 413 may include at least one slot 415.

The soundwave S traveling through either the primary path 412 or the secondary path 413 may leave in the same off-axis angular direction in relation to the axis 405. Alternatively, the secondary path may otherwise be oriented in relation to the axis 405, as long as the secondary path would direct the soundwave S to travel out in an off-axis direction. The secondary path via the at least one slot 415 provides another degree of freedom to optimize the frequency response of the acoustic lens 401.

The acoustic assembly 400 includes a horn 416 that may be attached to the first electroacoustic transducer 403. The horn 416 may be adhered, welded, molded, fastened via fasteners, held in place by a frictional interference engagement, or otherwise removably or permanently affixed to the first electroacoustic transducer 403. The horn 416 may be positioned in front of the output side of the first electroacoustic transducer 403. The horn 416 may be aligned on the axis 405.

The horn 416 may include a throat 417 and a mouth 418 that is distal to the throat 417. The throat 417 may be proximal to the first electroacoustic transducer 403. The mouth 418 may be distal to the first electroacoustic transducer 403. The horn 416 may direct soundwaves to travel from the throat 417 to the mouth 418. Therefore, the mouth 418 may be an output side of the horn 416. The throat 417 may be cross-sectionally shaped as a rectangle, a circle, an ellipse, a square, a parallelogram, a trapezoid, or another two-dimensional shape. The cross-sectional shape of the throat 417 may match the cross-sectional shape of the first electroacoustic transducer 403. The mouth 418 may be cross-sectionally shaped as a rectangle, a circle, an ellipse, a square, a parallelogram, a trapezoid, or another two-dimensional shape. The cross-sectional shape of the mouth 418 may differ from the cross-sectional shape of the throat 417.

The acoustic assembly 400 may include a phase plug 419. The phase plug may be integrally formed with the acoustic lens 401. Alternatively, the phase plug 419 may be a separate element from the acoustic lens 401. The acoustic lens 401 may be positioned in front of the output side of the horn 416. Additionally or alternatively, the acoustic lens 401 may be positioned at least partially in front of the output side of the horn 416. The phase plug 419 may be adhered, welded, molded, fastened via fasteners, held in place by a frictional interference engagement, or otherwise removably or permanently affixed to the acoustic lens 401. For example, the phase plug 419 may be affixed to a bottom surface 420 of the acoustic lens 401. Additionally or alternatively, the phase plug 419 may be may be adhered, welded, molded, fastened via fasteners, held in place by a frictional interference engagement, or otherwise removably or permanently affixed to the first electroacoustic transducer 403 and/or the horn 416.

The phase plug 419 may be positioned in the horn 416 and in front of the output side of the first electroacoustic transducer 403. The phase plug 419 and/or the acoustic lens 401 may be adhered, welded, molded, fastened via fasteners, held in place by a frictional interference engagement, or otherwise removably or permanently affixed to the horn 416. Proximal to the first electroacoustic transducer 403, for the primary path 412, the phase plug 419 and the horn 416 may have a first radial segment area A'. The first radial segment area A' is measured transverse to the axis 405 between the phase plug 419 and the horn 416. The first radial segment A' may be measured at or near the throat 417 of the horn 416. The first radial segment area A' is less than the cross-sectional open area of the horn 416. Moreover, as compared to other radial segment areas between the phase plug 419 and the horn 416 and radial segment areas between the acoustic lens 401 and the horn 416, the first radial segment area A' is the smallest.

From the first radial segment area A', the radial segment areas increase in size at least up to the mouth 418 of the horn 416. The rate of increase from the first radial segment area A' to at least the mouth of the horn 416 may, therefore, be positive. The rate of increase may be constant or non-constant. A linear equation may be used to calculate the positive rate of increase. Alternatively, a non-linear equation may be used to calculate the rate of increase. Alternatively, the rate of increase may be random.

At the mouth 418 of the horn 416, the radial segment area may be B'. In relation to the axis 405, when the bottom surface 420 of the acoustic lens 401 is transversally in-line with the mouth 418 of the horn 416, the radial segment area B' may be calculated between the bottom surface 420 of the acoustic lens 401 and the horn 416 accordingly. Alternatively, when the phase plug is transversally in-line with the mouth 418 of the horn 416 in relation to the axis 405, the radial segment area B' may be calculated between the phase plug 419 and the horn 416 accordingly. The radial segment area B' is greater than the radial segment area A'. Moreover, the radial segment area B' is greater than all other radial segment areas therebetween. Furthermore, each opening of the at least one opening 414 of the primary path 412 may include an open area C' that is greater than or equal to the radial segment area B'. In setting the minimum total value for the open area C' as such, soundwaves, such as S, are freer to flow out of the at least one opening 414, as opposed to wastefully reflecting within the acoustic lens 401.

The at least one slot 415 of the secondary path 413 may be drilled, cut, or otherwise formed through the phase plug 419 and/or acoustic lens 401. The secondary path via the at least one slot 415 may extend through the sidewall, a top surface, and/or a bottom surface 420 of the acoustic lens 401. The secondary path via the at least one slot 415 may extend through the phase plug 419. The primary path 412 may extend between the sidewall of the acoustic lens 401 and the horn 416. The primary path 412 may extend between the bottom surface 420 of the acoustic lens 401 and the horn 416. The primary path 412 may extend between the phase plug 419 and the horn 416. The sidewall of the acoustic lens 401 may include the at least one opening 414 of the primary path 412.

Each slot of the at least one slot 415 may include an entrance that is positioned in front of and proximal to the output side of the first electroacoustic transducer 403. Each slot of the at least one slot 415 may include an exit that is positioned in front of and distal to the output side of the first electroacoustic transducer 403. The entrance may receive the soundwave S, while the soundwave S is traveling in the direction along the axis 405. The entrance may be aligned on the axis 405, may be parallel to the axis 405, or may be otherwise oriented to receive the Soundwave S, while the Soundwave S is traveling in the direction along the axis 405. The exit may be oriented to direct the soundwave S to travel out in an off-axis direction. For example, the exit may be perpendicular to the axis 405. Alternatively, the exit may be otherwise angularly oriented to the axis 405 such that the exit is not aligned on or parallel to the axis 405. A smooth internal transition may occur between the entrance and exit to direct the soundwave S to travel out in an off-axis direction. The exit may be positioned above an opening of the at least one opening 414.

Similar to the primary path 412, an entrance of a slot of the at least one slot 415 may include a first cross-sectional area. An exit of the same slot of the at least one slot 415 may include a second cross-sectional area. The first cross-sectional area may be less than the second cross-sectional area. While traveling from the entrance to the exit of the same slot, the cross-sectional areas may increase in size. Similar to the primary path 412, the rate of increase may be positive, linear, constant, non-constant, non-linear, and/or random. Moreover, the second cross-sectional area may be the largest, as compared to other cross-sectional areas of the same slot. The second cross-sectional area may be less than the open area C'. As such, an opening of the at least one openings 414 may have a greater open area than the second cross-sectional area. The second cross-sectional area may be less than the first radial segment area A'. The first cross-sectional area may be less than the open area C' and the first radial segment area A'.

Figure 9:
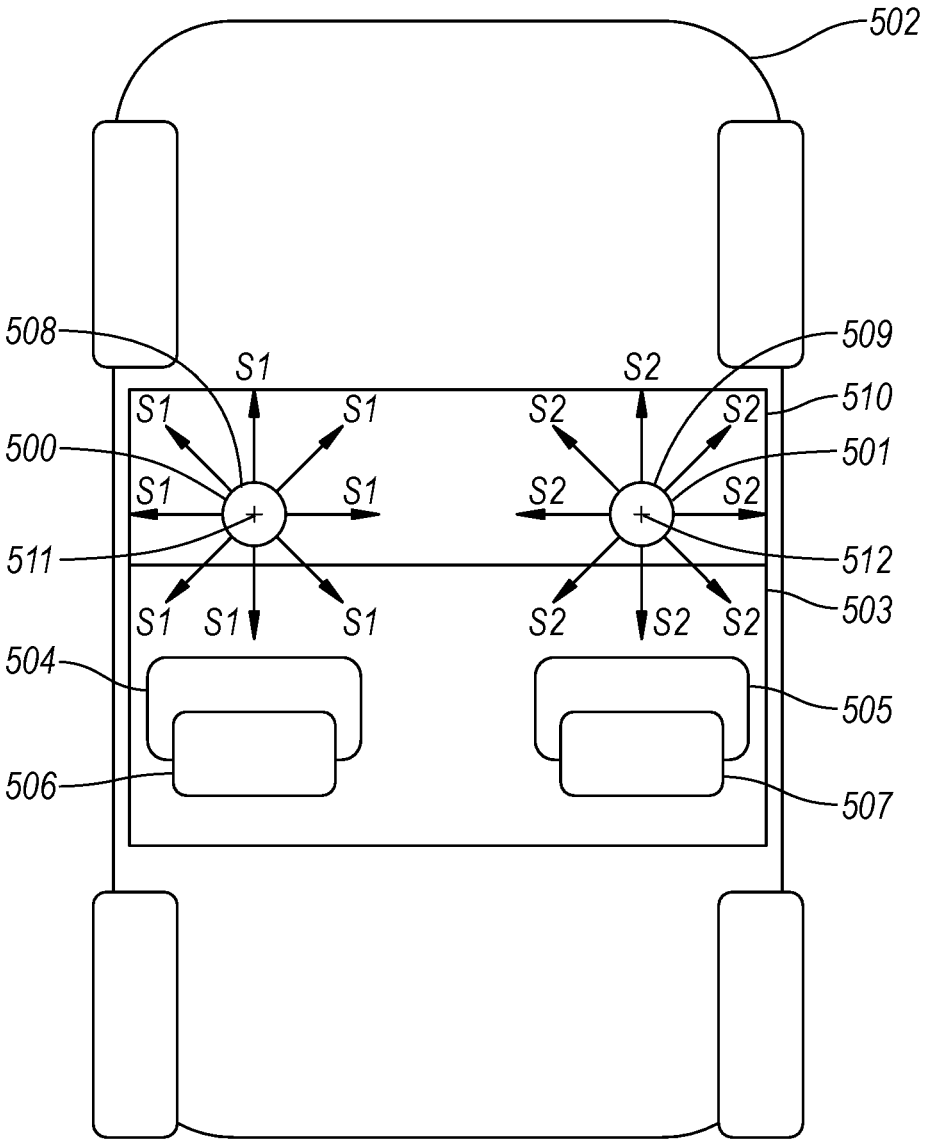
FIG. 9 illustrates an acoustic assembly in a vehicle.

FIG. 9 illustrates a first acoustic assembly 500 and a second acoustic assembly 501 in a vehicle 502, which is in accordance with one or more embodiments. The vehicle 502 includes a passenger cabin 503. The passenger cabin 503 is a listening environment. The listening environment includes a first seat 504 and a second seat 505. The first seat 504 includes a first headrest 506, and the second seat 505 includes a second headrest 507.

The first acoustic assembly 500 includes a first acoustic lens 508 and a first transducer. The second acoustic assembly 501 includes a second acoustic lens 509 and a second transducer. The first acoustic assembly 500 and the second acoustic assembly 501 are attached to a dashboard 510 of the vehicle 502. The first acoustic assembly 500 is aligned on a first axis 511, and the second acoustic assembly 501 is aligned on a second axis 512. The first axis 511 and the second axis 512 may be parallel to one another.

In relation to the first axis 511, when the first transducer generates a soundwave S1 (which may be in a direction along the first axis 511), the soundwave S1 travels through the first acoustic lens 508 and exists an opening of the first acoustic lens in an off-axis direction. The first acoustic lens 508 may, therefore, direct the soundwave S1 from traveling in a direction along the first axis 511 to traveling in an off-axis direction. The first acoustic lens 508 may, therefore, direct the soundwave S1 to the first seat 504, such as to the first headrest 506 of the first seat 504. In relation to the second axis 512, when the second transducer generates a soundwave S2 (which may be in a direction along the second axis 512), the soundwave S2 travels through the second acoustic lens 509 and exits an opening of the second acoustic lens 509 in an off-axis direction. The second acoustic lens 509 may, therefore, direct the soundwave S2 from traveling in a direction along the second axis 512 to traveling in an off-axis direction. The second acoustic lens 509 may, therefore, direct the soundwave S2 to the second seat 505, such as to the second headrest 507 of the second seat 505.

Moreover, the opening of the first acoustic lens 508 may provide nearly 360° line-of-sight, and the opening of the second acoustic lens 509 may provide nearly 360° line-of-sight. The nearly 360° line-of-sights may result in 360° off-axis acoustic radiation patterns. Because of the nearly 360° line-of-sights, the first seat 504, such as at the first headrest 506 of the first seat 504, may directly receive soundwaves S1 and S2. Additionally, because of the nearly 360° line-of-sights, the first seat 504, such as the first headrest 506 of the first seat 504, may indirectly receive reflections of the soundwaves S1 and S2. The reflections may occur by the soundwaves S1 and S2 reflecting off of a windshield, a side-window, or other structure of the vehicle. Similarly, because of the nearly 360° line-of-sights, the second seat 505, such as the second headrest 507 of the second seat 505, may directly receive soundwaves S1 and S2. Furthermore, because of the nearly 360° line-of-sights, the second seat 505, such as the second headrest 507 of the second seat 505, may receive reflections of the soundwaves S1 and S2. Similarly, the reflections may occur by the soundwaves S1 and S2 reflecting off of a windshield, a side-window, or other structure of the vehicle.

While FIG. 9 provides the first acoustic assembly and the second acoustic assembly, additional acoustic assemblies may be used in the vehicle. Additionally, the first acoustic assembly and the second acoustic assembly may be connected to a power source onboard of the vehicle, such as an audio amplifier. Moreover, the first acoustic assembly and the second acoustic assembly may be connected and in communication with a radio, an infotainment system, and/or a multimedia player in the vehicle. Furthermore, the first acoustic assembly and the second acoustic assembly may be connected to additional transducers in the vehicle. The first acoustic assembly and the second acoustic assembly may be used in a mono-acoustic system, a stereo-acoustic system, or a multi-channel acoustic system.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An acoustic lens comprising:

a top surface aligned on an axis and having a perimeter distal to the axis;

a sidewall that extends from the perimeter of the top surface and includes a leg, wherein the leg and the top surface define an opening for a soundwave from a transducer to travel through in an off-axis direction relative to the axis; and a bottom surface that is generally opposite the top surface for being positioned in front of an output side of the transducer and for directing the soundwave from the transducer to travel through the opening, wherein the bottom surface includes a non-uniform profile in relation to the axis.

2. The acoustic lens of claim 1, wherein the top surface and the sidewall are centered on the axis such that the perimeter of the top surface and the sidewall are coaxially aligned on the axis.

3. The acoustic lens of claim 1, wherein the sidewall includes a rim extending from the leg that further defines the opening for the soundwave from the transducer to travel through in the off-axis direction.

4. The acoustic lens of claim 3, wherein the rim includes a foot for attaching the acoustic lens to a frame of the transducer.

5. The acoustic lens of claim 3, wherein the top surface has a circular profile and the rim has a circular profile, wherein the rim is aligned on the axis such that the top surface and the rim are coaxially aligned on the axis.

6. The acoustic lens of claim 1, wherein the bottom surface includes a taper that extends inward from the perimeter of the top surface toward the axis.

7. The acoustic lens of claim 1, wherein the leg is a plurality of legs and as such the top surface and the plurality of legs define the opening as a plurality of openings.

8. The acoustic lens of claim 7, wherein the plurality of legs are equally and radially spaced from one another in relation to the axis.

9. An acoustic assembly comprising:

a transducer aligned on an axis and configured to generate a soundwave to travel in a direction along the axis; and an acoustic lens positioned in front of an output side of the transducer, aligned on the axis, and configured to direct the soundwave from the transducer from traveling in the direction along the axis to traveling in an off-axis direction, the acoustic lens including:

a top surface;

a sidewall that includes a leg that extends from the top surface, wherein the top surface and the leg define an opening for the soundwave from the transducer to travel through in the off-axis direction; and a bottom surface, having a non-uniform profile, that is generally opposite the top surface for directing the soundwave to travel through the opening.

10. The acoustic assembly of claim 9, wherein the top surface includes a perimeter distal to the axis, wherein the leg extends from the perimeter of the top surface.

11. The acoustic assembly of claim 10, wherein the top surface, the sidewall, and the transducer are centered on the axis such that the perimeter of the top surface, the sidewall, and the transducer are coaxially aligned on the axis.

12. The acoustic assembly of claim 10, wherein the sidewall includes a rim extending from the leg that further defines the opening for the soundwave from the transducer to travel through in the off-axis direction.

13. The acoustic assembly of claim 9, wherein the bottom surface of the acoustic lens extends past the sidewall in relation to the axis.

14. The acoustic assembly of claim 9, wherein the bottom surface includes a taper that extends inward from the top surface toward the axis.

15. The acoustic assembly of claim 9, wherein the acoustic lens is configured to direct the soundwave from the transducer to travel in the off-axis direction in a 360° acoustic radiation pattern about the axis.

16. The acoustic assembly of claim 9, wherein the leg is a plurality of legs and as such the top surface and the plurality of legs define the opening as a plurality of openings.

17. The acoustic assembly of claim 16, wherein the plurality of legs are equally and radially spaced from one another in relation to the axis.

18. The acoustic assembly of claim 9, further comprising:

a horn coupled to the transducer and spaced apart from the bottom surface of the acoustic lens to define a primary path with the bottom surface to direct the soundwave from the transducer to travel in the off-axis direction in relation to the axis.

* * * * *